US009162479B2

(12) United States Patent
Nakamura

(10) Patent No.: US 9,162,479 B2
(45) Date of Patent: Oct. 20, 2015

(54) INKJET PRINTER HAVING OFFSET NOZZLE ARRAYS

(71) Applicant: RISO KAGAKU CORPORATION, Tokyo (JP)

(72) Inventor: Hiroyuki Nakamura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/468,798

(22) Filed: Aug. 26, 2014

(65) Prior Publication Data

US 2015/0070426 A1 Mar. 12, 2015

(30) Foreign Application Priority Data

Sep. 12, 2013 (JP) ..... 2013-188970

(51) Int. Cl.
*B41J 29/38* (2006.01)
*B41J 2/21* (2006.01)
*B41J 2/155* (2006.01)

(52) U.S. Cl.
CPC ..... *B41J 2/2146* (2013.01); *B41J 2/155* (2013.01); *B41J 2/21* (2013.01); *B41J 2/2132* (2013.01); *B41J 2/2135* (2013.01)

(58) Field of Classification Search
CPC ..... B41J 2/0458; B41J 2/04501; B41J 2/145; B41J 2/155; B41J 2/04573; B41J 2/2135; B41J 2/2146
USPC ..... 347/5, 12
See application file for complete search history.

(56) References Cited

U.S. PATENT DOCUMENTS

2005/0184169 A1* 8/2005 Eguchi et al. ..... 239/135
2005/0212834 A1* 9/2005 Akahira et al. ..... 347/5
2008/0284808 A1* 11/2008 Kano et al. ..... 347/12
2013/0235108 A1* 9/2013 Mizuno et al. ..... 347/15

FOREIGN PATENT DOCUMENTS

JP 2010-162755 A 7/2010

OTHER PUBLICATIONS

U.S. Appl. No. 14/483,704 to Hiroyuki Nakamura, filed Sep. 11, 2014.

* cited by examiner

*Primary Examiner* — Julian Huffman
*Assistant Examiner* — Sharon A Polk
(74) *Attorney, Agent, or Firm* — Greenblum & Bernstein, P.L.C.

(57) ABSTRACT

Positions of a plurality of nozzles of at least one first nozzle array of a plurality of nozzle arrays and positions of a plurality of nozzles of at least one second nozzle array of the plurality of nozzle arrays other than the at least one first nozzle array are offset from one another in a nozzle arrangement direction. A controller is configured to control ejection timings of ink from the plurality of nozzle arrays such that dots of the ink of the colors for each same pixel are offset from each other by an equal offset amount in the nozzle arrangement direction and a relative movement direction orthogonal to the nozzle arrangement direction.

2 Claims, 10 Drawing Sheets

INKJET PRINTER HAVING OFFSET NOZZLE ARRAYS

CROSS REFERENCE TO RELATED APPLICATION

This application is based upon and claims the benefit of priority from the prior Japanese Patent Application No. 2013-188970, filed on Sep. 12, 2013, the entire contents of which are incorporated herein by reference.

BACKGROUND

1. Technical Field

This disclosure relates to an inkjet printer configured to perform printing by ejecting inks to a print medium.

2. Related Art

Japanese Patent Application Publication No. 2010-162755 proposes an inkjet printer configured to print an image by ejecting droplets of ink from nozzles of an inkjet head to a sheet.

An inkjet printer capable of performing color printing by using multiple color inks includes multiple inkjet heads configured to respectively eject these color inks. In color printing, the color inks ejected from nozzles of the inkjet heads are landed on the sheet in an overlapping manner for each pixel.

Among line inkjet printers, there is one using inkjet heads which each include two nozzle arrays and in which nozzle positions of the two nozzle arrays in the main scanning direction are offset from each other by half the nozzle pitch (half pitch). Moreover, among such inkjet heads, there is one in which the inkjet head can eject different color inks from the two nozzle arrays. This can reduce the number of inkjet heads in an inkjet printer capable of color printing, compared to a case of using inkjet heads each having one nozzle array only.

SUMMARY

In a case of arranging multiple inkjet heads like one described above, the inkjet heads are arranged in such a way that the nozzle positions in the main scanning direction coincide among all the inkjet heads. Moreover, since the two nozzle arrays in each of the inkjet heads are offset from each other by a half pitch as described above, a pixel is formed by using the nozzles provided in the adjacent nozzle arrays at positions away from each other by a half pitch in the main scanning direction.

For example, there is a case where a nozzle array configured to eject a cyan (C) ink and a nozzle array configured to eject a magenta (M) ink are offset from each other by a half pitch in the main scanning direction. In this case, the cyan and magenta inks for forming the same pixel are ejected from two nozzles positioned away from each other by a half pitch in the main scanning direction.

Accordingly, when a line of a secondary color of cyan and magenta is printed, a line extending along a sub-scanning direction is thicker than a line extending along the main scanning direction. In particular, this difference in thickness is highly visible in a fine line with a width of one pixel.

Moreover, if an inkjet printer prints a solid region and forms a blank portion not filled with dots in the solid region, a print density of the solid region decreases and print quality deteriorates. Also, in some cases, the inkjet printer using the inkjet heads like one described above forms a blank portion not filled with dots in a solid region and the print quality deteriorates.

An object of the present invention is to provide an inkjet printer capable of suppressing deterioration in print quality.

An inkjet printer in accordance with some embodiments includes: a printing unit including a printing unit including a plurality of nozzle arrays each having a plurality of nozzles arranged at an interval in a nozzle arrangement direction and configured to eject ink, the plurality of nozzle arrays being configured to eject the ink of different colors from each other from the plurality of nozzles; a driver configured to move the printing unit and a print medium relative to each other in a relative movement direction orthogonal to the nozzle arrangement direction; and a controller configured to control the printing unit and the driver such that the printing unit ejects the ink from the plurality of nozzles to the print medium on a basis of image data while the driver moves the printing unit and the print medium relative to each other. Positions of the plurality of nozzles of at least one first nozzle array of the plurality of nozzle arrays and positions of the plurality of nozzles of at least one second nozzle array of the plurality of nozzle arrays other than the at least one first nozzle array are offset from one another in the nozzle arrangement direction. The controller is configured to control ejection timings of the ink from the plurality of nozzle arrays such that dots of the ink of the colors for each same pixel are offset from each other by an equal offset amount in the relative movement direction and the nozzle arrangement direction.

According to the configuration described above, the controller controls the ejection timings of the inks from the nozzle arrays in such a way that the dots of the inks of respective colors for each pixel are offset from each other by an equal offset amount in the nozzle arrangement direction and the relative movement direction of the printing unit and the print medium. Due to this, a blank portion in a solid region can be reduced. Moreover, a line along the nozzle arrangement direction and a line along the relative movement direction can be printed in the same thickness, the lines formed by using the inks of colors from the plurality of nozzle arrays some of which include the nozzles at positions offset in the nozzle arrangement direction. As a result, deterioration in print quality can be suppressed.

The controller may be configured to reduce ink ejection amounts of the colors for each pixel in first and second lines contained in the image data from original ink ejection amounts based on the image data, the first and second lines being to be formed by using the ink of the colors from the at least one first nozzle array and the at least one second nozzle array, the first line extending in the nozzle arrangement direction and having a width equal to or smaller than a predetermined number of pixels, the second line extending in the relative movement direction and having a width equal to or smaller than the predetermined number of pixels.

According to the configuration described above, for the lines that are to be formed by using the inks of the colors from the plurality of nozzle arrays one of which including the nozzles at positions offset in the nozzle arrangement direction, one of the lines extending in the nozzle arrangement direction and having a width equal to or smaller than a predetermined number of pixels, the other line extending in the relative movement direction and having a width equal to or smaller than the predetermined number of pixels, the controller reduces the ink ejection amounts of the colors for each of pixels in the lines from the original ink ejection amounts based on the image data. This can reduce the thicknesses of these lines and make the lines have thicknesses closer to original thicknesses based on the image data.

DETAILED DESCRIPTION

Figure 1:
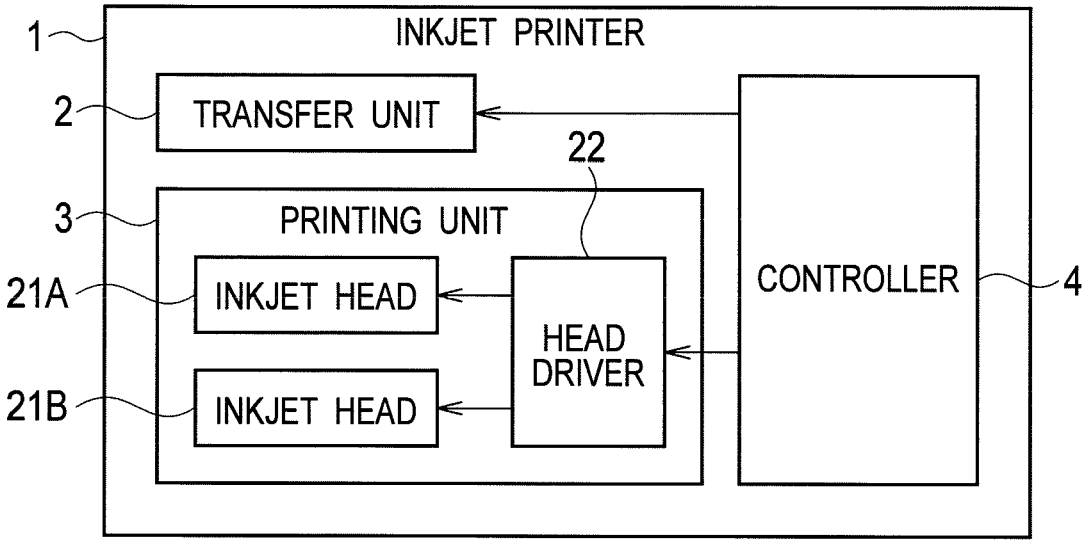
FIG. 1 is a block diagram showing a configuration of an inkjet printer in the embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
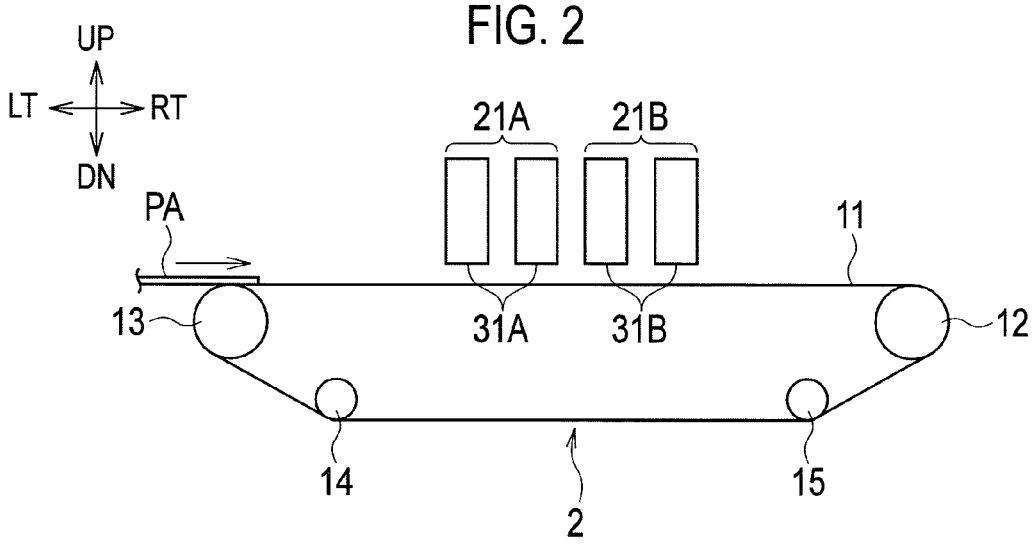
FIG. 2 is a schematic configuration diagram of a transfer unit and an inkjet head.
Figure 3:
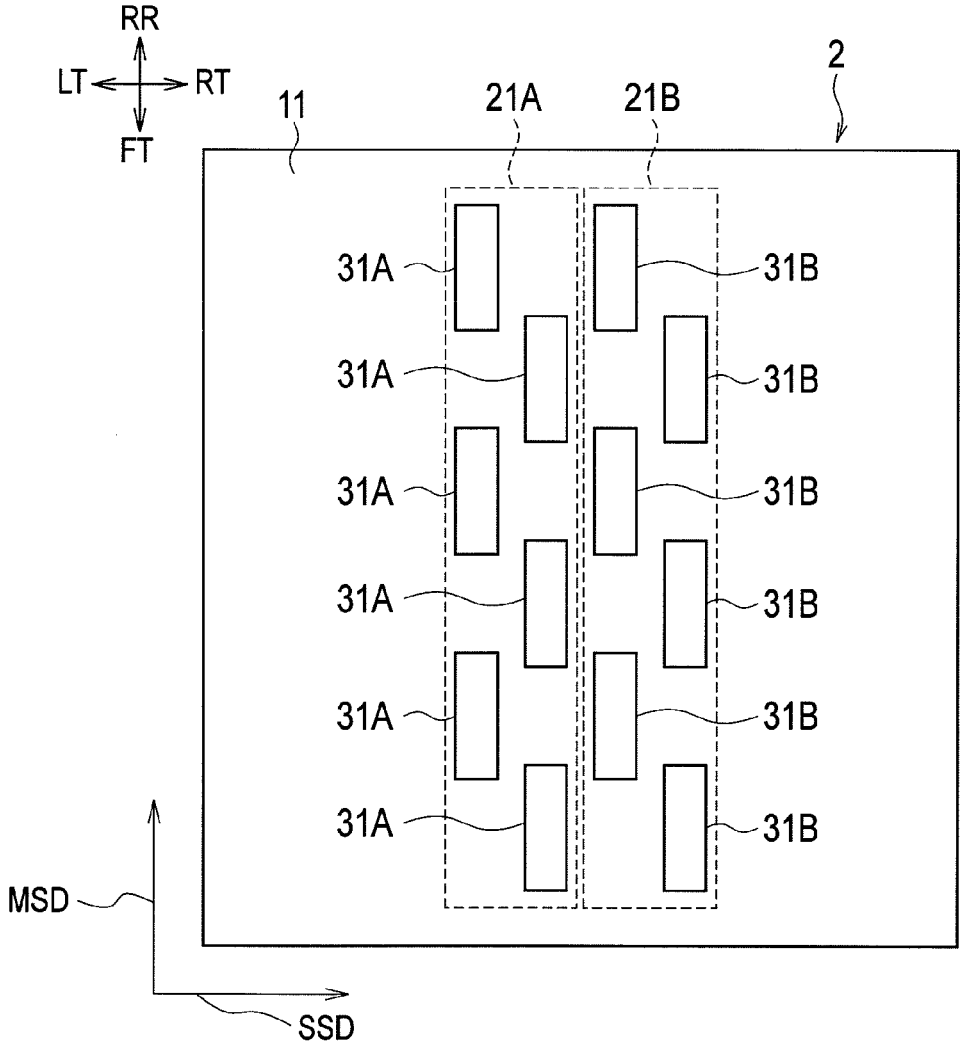
FIG. 3 is a plan view of the transfer unit and the inkjet head.
Figure 4:
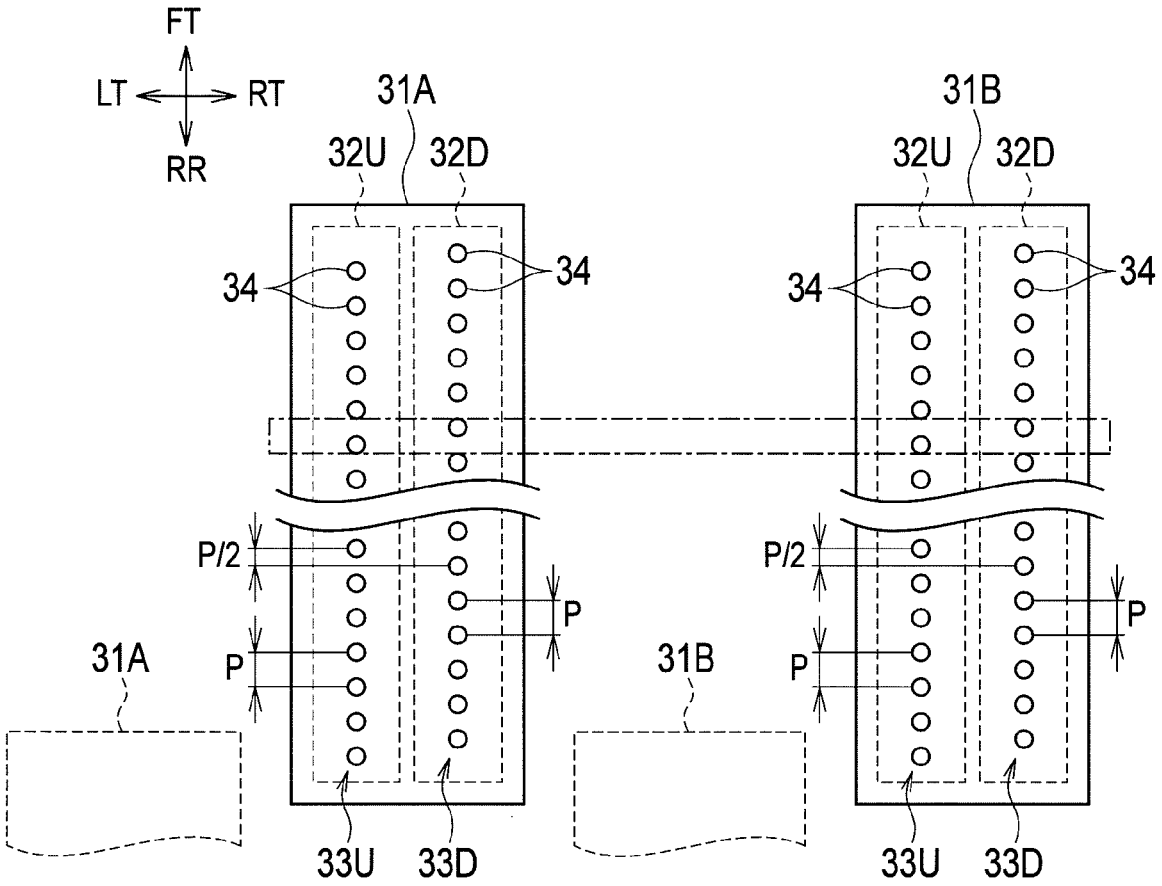
FIG. 4 is a schematic configuration diagram of a head module.

FIG. 1 is a block diagram showing a configuration of an inkjet printer in an embodiment of the present invention. FIG. 2 is a schematic configuration diagram of a transfer unit and an inkjet head of the inkjet printer shown in FIG. 1. FIG. 3 is a plan view of the transfer unit and the inkjet head. FIG. 4 is a schematic configuration diagram of a head module.

In the following description, a direction orthogonal to a sheet surface of FIG. 2 is assumed to be a front-rear direction (main scanning direction) in the inkjet printer and a direction toward the front of the sheet surface is assumed to be a frontward direction. Moreover, up, down, left, and right in the sheet surface of FIG. 2 are assumed to be upward, downward, leftward, and rightward directions in the inkjet printer, respectively. In FIG. 2, a direction from left to right is a transfer direction (sub-scanning direction) (relative movement direction) of a sheet PA. In the following description, upstream and downstream mean upstream and downstream in the transfer direction. In the drawings, the rightward direction, the leftward direction, the upward direction, the downward direction, the frontward direction, and the rearward direction are denoted by RT, LT, UP, DN, FT, and RR, respectively. Moreover, in the drawings, the transfer direction (sub-scanning direction) of the sheet PA and the front-rear direction (main scanning direction) are denoted by SSD and MSD, respectively.

As shown in FIG. 1, an inkjet printer 1 of the embodiment includes a transfer unit (driver) 2, a printing unit 3, and a controller 4.

The transfer unit 2 transfers the sheet PA. As shown in FIG. 2, the transfer unit 2 includes a transfer belt 11, a drive roller 12, and driven rollers 13, 14, 15.

The transfer belt 11 transfers the sheet PA while sucking and holding the sheet PA. The transfer belt 11 is an annular belt wound around the drive roller 12 and the driven rollers 13 to 15. Many belt holes for sucking and holding the sheet PA are formed in the transfer belt 11. The transfer belt 11 sucks and holds the sheet PA on a top surface thereof by using sucking force generated at the belt holes by drive of a fan (not illustrated). The transfer belt 11 is rotated clockwise in FIG. 2 to transfer the sucked and held sheet PA rightward.

The drive roller 12 rotates the transfer belt 11. The drive roller 12 is driven by a not-illustrated motor.

The driven rollers 13 to 15 are driven by the drive roller 12 via the transfer belt 11. The driven roller 13 is disposed on the left side of the drive roller 12 at substantially the same height as the drive roller 12. The driven rollers 14, 15 are disposed below the drive roller 12 and the driven roller 13 at substantially the same height while being spaced away from each other in the left-right direction.

The printing unit 3 prints an image on the sheet PA transferred by the transfer unit 2. The printing unit 3 includes inkjet heads 21A, 21B and a head driver 22.

The inkjet heads 21A, 21B are line inkjet heads and eject inks to the sheet PA transferred by the transfer unit 2. As will be described later, the inkjet head 21A ejects black (K) and yellow (Y) inks. The inkjet head 21B ejects cyan (C) and magenta (M) inks. The inkjet heads 21A, 21B are arranged in this order from the upstream side at a predetermined interval in the transfer direction (left-right direction) of the sheet PA.

The inkjet head 21A has multiple head modules 31A and the inkjet head 21B has multiple head modules 31B. In the embodiment, as shown in FIG. 3, the inkjet head 21A has six head modules 31A and the inkjet head 21B has six head modules 31B. Note that the inkjet heads 21A, 21B and the head modules 31A, 31B are described generally in some cases by omitting the alphabet letters attached to the reference numerals.

In each of the inkjet heads 21, the six head modules 31 are arranged in a zigzag pattern along the front-rear direction (main scanning direction) orthogonal to the transfer direction (sub-scanning direction) of the sheet PA. Specifically, the six head modules 31 are arranged along the front-rear direction with the positions thereof being alternately offset in the left-right direction.

Each of the head modules 31 ejects two color inks. As shown in FIG. 4, the head module 31 has two ink chambers 32U, 32D and two nozzle arrays 33U, 33D. FIG. 4 is a bottom view of the head modules 31A, 31B in the same row in the left-right direction. Note that the ink chambers 32U, 32D and the nozzle arrays 33U, 33D are described generally in some cases by omitting the alphabet letters attached to the reference numerals.

The ink chambers 32 store the inks. The inks are supplied to the ink chambers 32 through ink passages (not illustrated). Piezoelectric elements (not illustrated) are disposed in the ink chambers 32. The inks are ejected from later-described nozzles 34 by drive of the piezoelectric elements.

The black ink is supplied to the ink chamber 32U of each head module 31A. The yellow ink is supplied to the ink chamber 32D of each head module 31A. The cyan ink is supplied to the ink chamber 32U of each head module 31B. The magenta ink is supplied to the ink chamber 32D of each head module 31B.

The nozzle arrays 33U, 33D are arranged parallel to each other in the left-right direction (sub-scanning direction). Each of the nozzle arrays 33 includes multiple nozzles 34 configured to eject the corresponding ink. In the head modules 31, the number of droplets (droplet number) of the ink ejected from one nozzle 34 for one pixel can be changed to perform gradation printing in which density is expressed by the number of droplets.

In each of the nozzle arrays 33, the multiple nozzles 34 are arranged along the main scanning direction (front-rear direction) at equal intervals at a predetermined pitch P. Moreover, the nozzles 34 of each upstream nozzle array 33U and the nozzles 34 of the corresponding downstream nozzle array 33D are arranged to be offset from one another by a half pitch (P/2) in the main scanning direction which is a nozzle arrangement direction. The nozzles 34 are opened on a bottom surface of each head module 31.

The nozzles 34 of the upstream nozzle array 33U of each head module 31A eject the black ink supplied to the ink chamber 32U of the head module 31A. The nozzles 34 of the downstream nozzle array 33D of each head module 31A eject the yellow ink supplied to the ink chamber 32D of the head module 31A. The nozzles 34 of the upstream nozzle array 33U of each head module 31B eject the cyan ink supplied to the ink chamber 32U of the head module 31B. The nozzles 34 of the downstream nozzle array 33D of each head module 31B eject the magenta ink supplied to the ink chamber 32D of the head module 31B.

Here, the head modules 31A and the head modules 31B are arranged such that the nozzle positions in the main scanning direction coincide with one another. Specifically, the nozzle array 33U of each head module 31A and the nozzle array 33U of the corresponding head module 31B have the nozzles 34 at the same positions in the main scanning direction. Moreover, the nozzle array 33D of each head module 31A and the nozzle array 33D of the corresponding head module 31B have the nozzles 34 at the same positions in the main scanning direction.

Since the nozzles 34 are arranged as shown in FIG. 4, the inkjet printer 1 forms the same pixels by using the nozzles 34 at positions away from one another by a half pitch in the main scanning direction in each pair of the adjacent nozzle arrays. One combination of the nozzles 34 in the head modules 31A, 31B for the same pixel is encircled by a one-dot chain line in FIG. 4.

As shown in FIG. 4, in each of the head modules 31A, 31B, the nozzle 34 of the nozzle array 33U and the nozzle 34 of the nozzle array 33D for the same pixel are offset from each other by a half pitch in the main scanning direction. Moreover, in the downstream nozzle array 33D of the head module 31A and the upstream nozzle array 33U of the head module 31B, the nozzles 34 for the same pixel are arranged at the positions offset from each other by a half pitch in the main scanning direction.

The head driver 22 drives the inkjet heads 21. Specifically, the head driver 22 drives the piezoelectric elements in the ink chambers 32 of the head modules 31 and causes the inks to be ejected from the nozzles 34.

The controller 4 controls operations of various parts of the inkjet printer 1. The controller 4 includes a CPU, a RAM, a ROM, a hard disk drive, and the like.

The controller 4 controls the transfer unit 2 and the printing unit 3 in such a way that an image is printed by ejecting the inks from the nozzles 34 of the inkjet heads 21 to the sheet PA on the basis of droplet data while transferring the sheet PA in printing. The droplet data is image data in a format corresponding to ink ejection by the inkjet heads 21.

The controller 4 controls ejection timings of the inks from the nozzle arrays 33 such that dots of the color inks for each pixel can be offset from one another by an equal offset amount in the main scanning direction and the sub-scanning direction. Here, the offset amount is a distance between the centers of the dots.

Specifically, the controller 4 controls the ejection timings of the color inks such that the yellow and magenta inks ejected from the nozzle arrays 33D of the head modules 31A, 31B for the same pixel form dots by landing at positions offset by a half pitch (P/2) in the sub-scanning direction from black and cyan dots formed by the inks ejected from the nozzle arrays 33U of the head modules 31A, 31B.

Moreover, for fine lines along the main scanning direction and the sub-scanning direction to be formed with color inks from the multiple nozzle arrays 33 some of which include the nozzles 34 at the positions offset in the main scanning direction, the controller 4 reduces the numbers of droplets (ink ejection amounts) of the color inks for each of pixels in the fine lines. Here, the fine lines are assumed to be lines with a width of one pixel.

For example, assume that a fine line extending along the main scanning direction is printed by using the cyan and magenta inks. The positions of the nozzles 34 are offset from one another in the main scanning direction between the nozzle arrays 33U of the head modules 31B which eject the cyan ink and the nozzle arrays 33D of the head modules 31B which eject the magenta ink. In this case, the controller 4 reduces the numbers of droplets of the cyan and magenta inks for each pixel, from the original numbers of droplets.

Moreover, when a fine line extending along the sub-scanning direction is printed by using the cyan and magenta inks, the controller 4 also reduces the numbers of droplets of the cyan and magenta inks for each pixel, from the original numbers of droplets.

Next, operations of the inkjet printer 1 are described.

In a case of performing printing, the controller 4 performs fine line processing on the droplet data. The droplet data is data showing the numbers of droplets (drop numbers) of the color inks to be ejected for each of the pixels. The fine line processing is processing in which the numbers of droplets of the respective color inks for each pixel in the fine line extending along the main scanning direction and the fine line extending along the sub-scanning direction are reduced from the original numbers of droplets, the fine line formed by using the color inks from the multiple nozzle arrays 33 some of which include the nozzles 34 at the positions offset in the main scanning direction.

Figure 6:
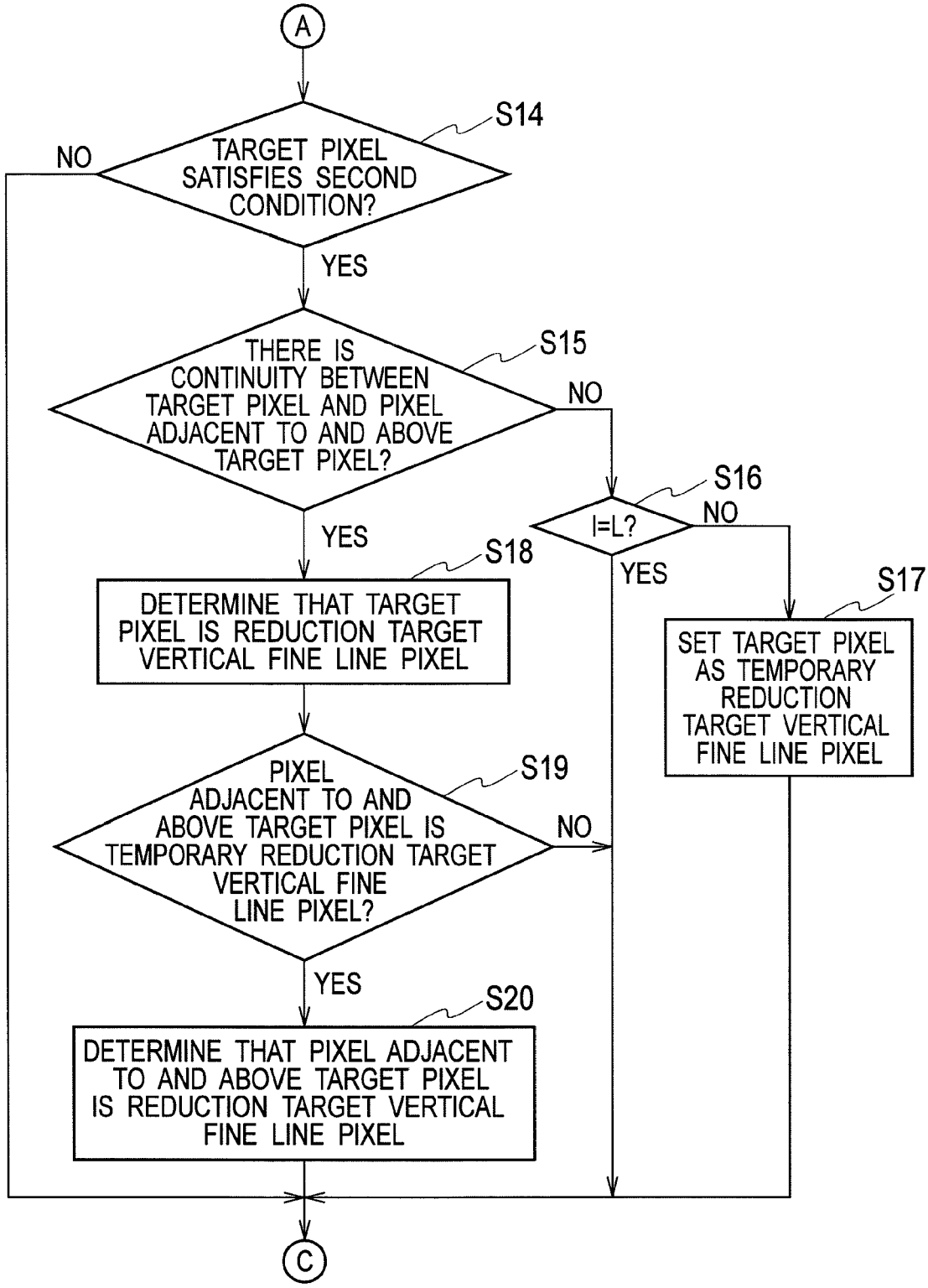
FIG. 6 is a flowchart of the fine line processing.
Figure 7:
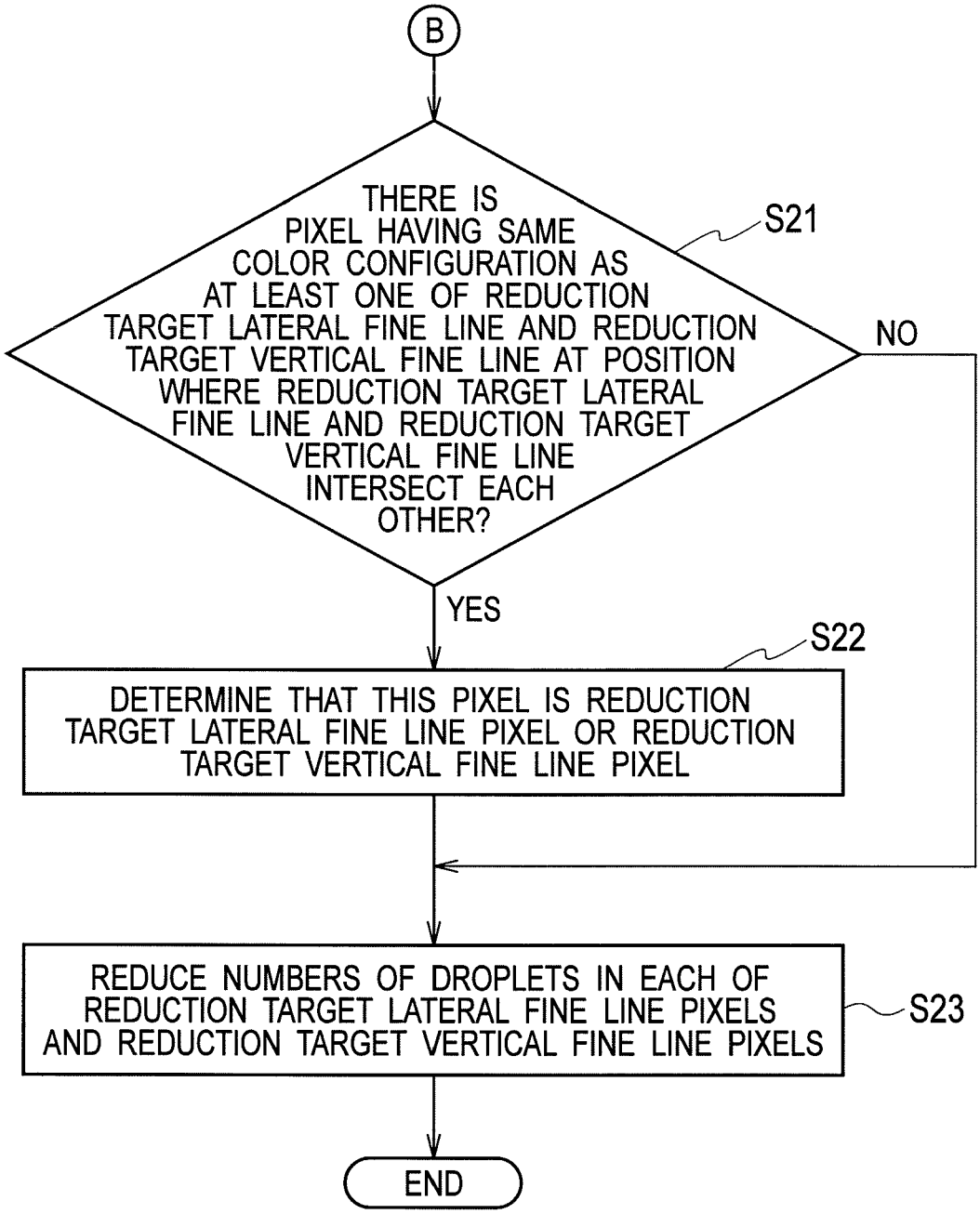
FIG. 7 is a flowchart of the fine line processing.

The fine line processing is described with reference to the flowcharts of FIGS. 5 to 7.

Figure 5:
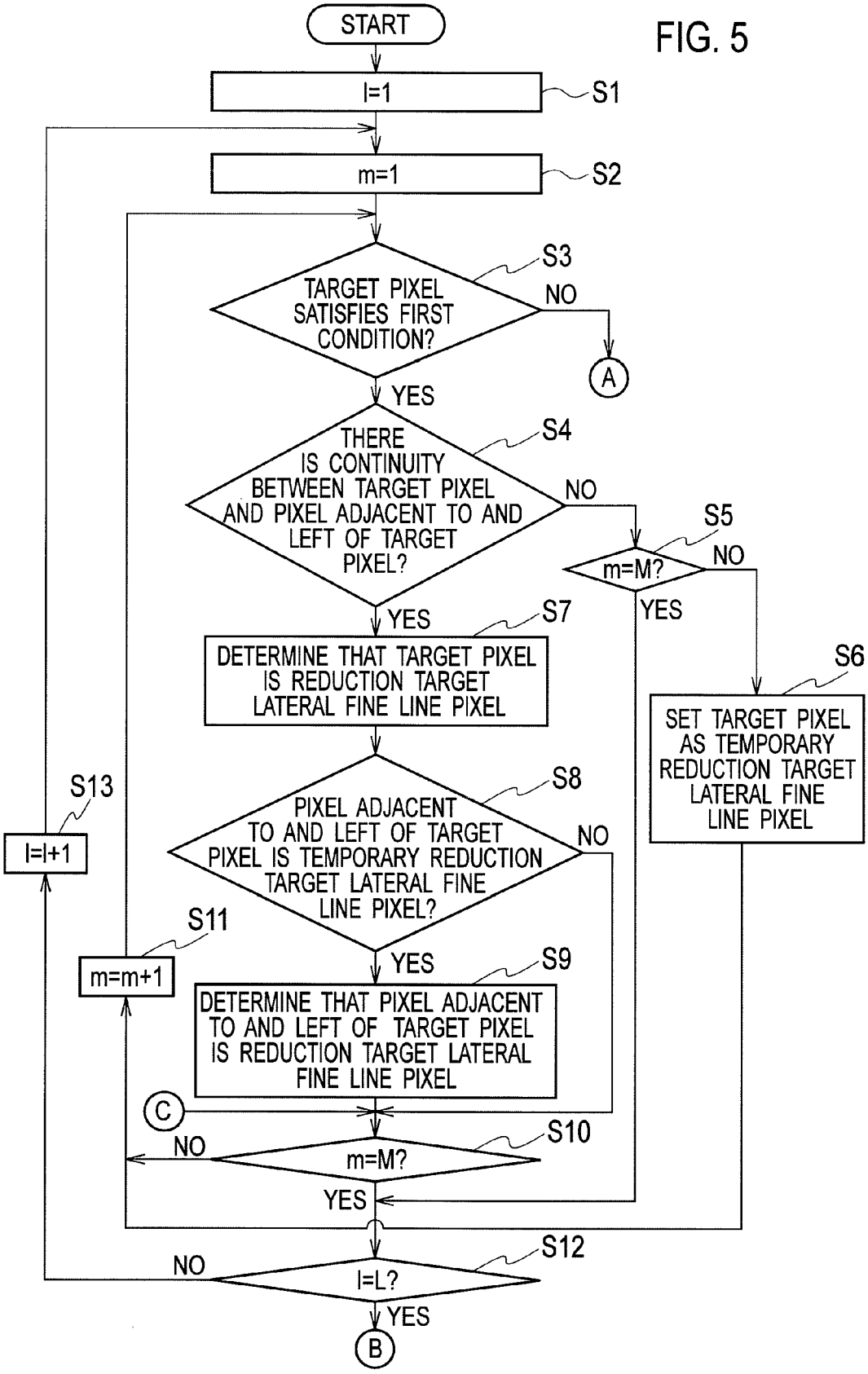
FIG. 5 is a flowchart of fine line processing.

First, in step S1 of FIG. 5, the controller 4 sets a variable l showing a line number in the droplet data to "1". Here, the first line in the droplet data is she upper most line and the greater line number indicates that the line is located at a lower position.

Next, in step S2, the controller 4 sets a variable m showing a pixel number on the line to "1". Here, a pixel at a left end of the line is assumed to be the first pixel and the greater pixel number indicates that the pixel is located further to the right.

Next, in step S3, the controller 4 determines whether a target pixel which is an m-th pixel in an l-th line satisfies a first condition.

The first condition is a condition for determining whether the target pixel is a candidate for a reduction target lateral fine line pixel. The reduction target lateral fine line pixel is a pixel forming a reduction target lateral fine line which is a lateral fine line being a target for reduction of the numbers of droplets. The lateral fine line is a fine line extending along the left-right direction in the droplet data and is a fine line printed along the main scanning direction (or the sub-scanning direction) in printing. The reduction target lateral fine line is a lateral fine line printed by using the color inks from the multiple nozzle arrays 33 some of which include the nozzles 34 at the positions offset in the main scanning direction. For example, a lateral fine line printed by using the cyan and magenta inks is the reduction target lateral fine line.

The controller 4 determines that the first condition is satisfied when the numbers of droplets of multiple colors in the target pixel are not "0" and the numbers of droplets of all of the colors are "0" in pixels next to the target pixels on the upper and lower sides, the multiple colors including a color corresponding to the nozzle arrays 33 in which the positions of the nozzles 34 are offset in the main scanning direction. Here, the next upper pixel of the target pixel is an m-th pixel of an (l−1)th line. Meanwhile, the next lower pixel of the target pixel is an m-th pixel of an (l+1)th line.

For example, when the numbers of droplets of at least the cyan and magenta inks in the target pixel are not "0" and the numbers of droplets of all the colors in the next upper and lower pixels of the target pixel are "0", the controller 4 determines that the target pixel satisfies the first condition.

When there is no next upper pixel of the target pixel, i.e. when l=1 is satisfied, the controller 4 determines that the numbers of droplets of all the colors in the next upper pixel of the target pixel are "0". Similarly, when there is no next lower pixel of the target pixel, i.e. when the target pixel is a pixel of the last line (lowermost line), the controller 4 determines that the numbers of droplets of all the colors in the next lower pixel of the target pixel are "0".

When the controller 4 determines that the target pixel satisfies the first condition (step S3: YES), the controller 4 determines in step S4 whether there is continuity between the target pixel and a pixel next to the target pixel on the left side. The next left pixel of the target pixel is an (m−1)th pixel of the l-th line. When the next left pixel of the target pixel satisfies the first condition and the numbers of droplets of the respective colors are the same in the target pixel and the next left pixel of the target pixel, the controller 4 determines that there is continuity between the target pixel and the next left pixel of the target pixel.

When there is no next left pixel of the target pixel, i.e. when m=1 is satisfied, the controller 4 determines that there is no continuity between the target pixel and the next left pixel of the target pixel.

When the controller 4 determines that there is no continuity between the target pixel and the next left pixel of the target pixel (step S4: NO), the controller 4 determines in step S5 whether the variable m is M indicating the last pixel (pixel at the right end) in the l-th line. When the controller determines that m=M is satisfied (step S5: YES), the controller 4 proceeds to step S12.

When the controller 4 determines that m=M is not satisfied (step S5: NO), the controller 4 sets the target pixel as a temporary reduction target lateral fine line pixel in step S6. Thereafter, the controller 4 proceeds to step S11.

When the controller 4 determines in step S4 that there is continuity between the target pixel and the next left pixel of the target pixel (step S4: YES), the controller 4 determines in step S7 that the target pixel is the reduction target lateral fine line pixel.

Then, in step S8, the controller 4 determines whether the next left pixel of the target pixel is the temporary reduction target lateral fine line pixel.

When the controller 4 determines that the next left pixel of the target pixel is the temporary reduction target lateral fine line pixel (step S8: YES), the controller 4 determines in step S9 that the next left pixel of the target pixel is the true reduction target lateral fine line pixel.

Next, in step S10, the controller 4 determines whether m=M is satisfied.

When the controller 4 determines that m=M is not satisfied (step S10: NO), the controller 4 adds "1" to the variable m in step S11. Thereafter, the controller 4 returns to step S3.

When the controller 4 determines that m=M is satisfied (step S10: YES), the controller 4 determines in step S12 whether the variable l is L indicating the last line (lowermost line).

When the controller 4 determines that l=L is not satisfied (step S12: NO), the controller 4 adds "1" to the variable l in step S13. Thereafter, the controller 4 returns to step S2. When the controller 4 determines that l=L is satisfied (step S12: YES), the controller 4 proceeds to step S21 of FIG. 7.

When the controller 4 determines in step S8 that the next left pixel of the target pixel is not the temporary reduction target lateral fine line pixel (step S8: NO), the controller 4 skips step S9 and proceeds to step S10.

When the controller 4 determines in step S3 that the target pixel does not satisfy the first condition (step S3: NO), the controller 4 determines in step S14 of FIG. 6 whether the target pixel satisfies a second condition.

The second condition is a condition for determining whether the target pixel is a candidate for a reduction target vertical fine line pixel. The reduction target vertical fine line pixel is a pixel forming a reduction target vertical fine line which is a vertical fine line being a target for reduction of the numbers of droplets. The vertical fine line is a fine line extending along the up-down direction in the droplet data and is a fine line printed along the sub-scanning direction (or the main scanning direction) in printing. The reduction target vertical fine line is a vertical fine line printed by using the color inks from the multiple nozzle arrays 33 some of which include the nozzles 34 at the positions offset in the main scanning direction. For example, a vertical fine line printed by using the cyan and magenta inks is the reduction target vertical fine line.

The controller 4 determines that the second condition is satisfied when the numbers of droplets of multiple colors in the target pixel are not "0" and the numbers of droplets of all the colors are "0" in pixels next to the target pixels on the left and right sides, the multiple colors including a color corresponding to the nozzle arrays 33 in which the positions of the nozzles 34 are offset in the main scanning direction. Here, the next left pixel of the target pixel is the (m−1)th pixel of the l-th line. Meanwhile, the next right pixel of the target pixel is an (m+1)-th pixel of the l-th line.

For example, when the numbers of droplets of at least the cyan and magenta inks in the target pixel are not "0" and the numbers of droplets of all the colors in the next left and right pixels of the target pixel are "0", the controller 4 determines that the target pixel satisfies the second condition.

When there is no next left pixel of the target pixel, i.e. when m=1 is satisfied, the controller 4 determines that the numbers of droplets of all the colors in the next left pixel of the target pixel are "0". Similarly, when there is no next right pixel of the target pixel, i.e. when m=M is satisfied, the controller 4 determines that the numbers of droplets of all the colors in the next right pixel of the target pixel are "0".

When the controller 4 determines that the target pixel does not satisfy the second condition (step S14: NO), the controller 4 proceeds to step S10 of FIG. 5.

When the controller 4 determines that the target pixel satisfies the second condition (step S14: YES), the controller 4 determines in step S15 whether there is continuity between the target pixel and a next upper pixel of the target pixel. The next upper pixel of the target pixel is an m-th pixel of a (l−1)th line. When the next upper pixel of the target pixel also satisfies the second condition and the numbers of droplets of the respective colors are the same in the target pixel and the next upper pixel of the target pixel, the controller 4 determines that there is continuity between the target pixel and the next upper pixel of the target pixel.

When there is no next upper pixel of the target pixel, i.e. when l=1 is satisfied, the controller 4 determines that there is no continuity between the target pixel and the next upper pixel of the target pixel.

When the controller 4 determines that there is no continuity between the target pixel and the next upper pixel of the target pixel (step S15: NO), the controller 4 determines in step S16 whether l=L is satisfied. When the controller 4 determines that l=L is satisfied (step S16: YES), the controller 4 proceeds to step S10.

When the controller 4 determines that l=L is not satisfied (step S16: NO), the controller 4 sets the target pixel as a temporary reduction target vertical fine line pixel in step S17. Thereafter, the controller 4 proceeds to step S10 of FIG. 5.

When the controller 4 determines in step S15 that there is continuity between the target pixel and the next upper pixel of the target pixel (step S15: YES), the controller 4 determines in step S18 that the target pixel is the reduction target vertical fine line pixel.

Then, in step S19, the controller 4 determines whether the next upper pixel of the target pixel is the temporary reduction target vertical fine line pixel.

When the controller 4 determines that the next upper pixel of the target pixel is the temporary reduction target vertical fine line pixel (step S19: YES), the controller 4 determines in step S20 that the next upper pixel of the target pixel is the true reduction target vertical fine line pixel. Thereafter, the controller 4 proceeds to step S10 of FIG. 5.

When the controller 4 determines in step S12 that l=L is satisfied (step S12: YES), the controller 4 determines in step S21 of FIG. 7 whether there is a pixel having the same color configuration as at least one of the reduction target lateral fine line and the reduction target vertical fine line at a position where the reduction target lateral fine line and the reduction target vertical fine line intersect each other. Here having the same color configuration means that the numbers of droplets of all the colors are the same.

When the controller 4 determines that there is a pixel having the same color configuration as at least one of the reduction target lateral fine line and the reduction target vertical fine line at the position where the reduction target lateral fine line and the reduction target vertical fine line intersect each other (step S21: YES), the controller 4 determines in step S22 that this pixel is the reduction target lateral fine line pixel or the reduction target vertical fine line pixel. Thereafter, the controller 4 proceeds to step S23.

When the controller 4 determines that there is no pixel having the same color configuration as at least one of the reduction target lateral fine line and the reduction target vertical fine line at the position where the reduction target lateral fine line and the reduction target vertical fine line intersect each other (step S21: NO), the controller 4 proceeds to step S23.

In step S23, the controller 4 reduces the numbers of droplets in each of the reduction target lateral fine line pixels and the reduction target vertical fine line pixels, from the original numbers of droplets. Here, the controller 4 determines reduction amounts of the numbers of droplets of respective colors such that the fine line formed with the reduced numbers of droplets of the respective colors can have the same color tone as that formed with the number of droplets before the reduction. The fine line processing is thus completed.

When the fine line processing is completed, the controller 4 executes printing. Specifically, the controller 4 drives and rotates the drive roller 12 of the transfer unit 2. This causes the transfer belt 11 to rotate. When the sheet PA is fed from a not-illustrated feeder, the sheet PA is transferred by the transfer unit 2. The controller 4 drives the inkjet heads 21A, 21B and causes the inkjet heads 21A, 21B to eject droplets of inks to the sheet PA transferred by the transfer unit 2, on the basis of the droplet data subjected to the fine line processing. An image is thereby printed on the sheet PA.

Here, the controller 4 controls the ejection timings of the respective color inks such that the yellow and magenta inks ejected from the nozzle arrays 33D of the head modules 31A, 31B form dots for the same pixel by landing at positions offset by a half pitch (P/2) in the sub-scanning direction from black and cyan dots formed by the inks ejected from the nozzle arrays 33U of the head modules 31A, 31B.

Figure 8:
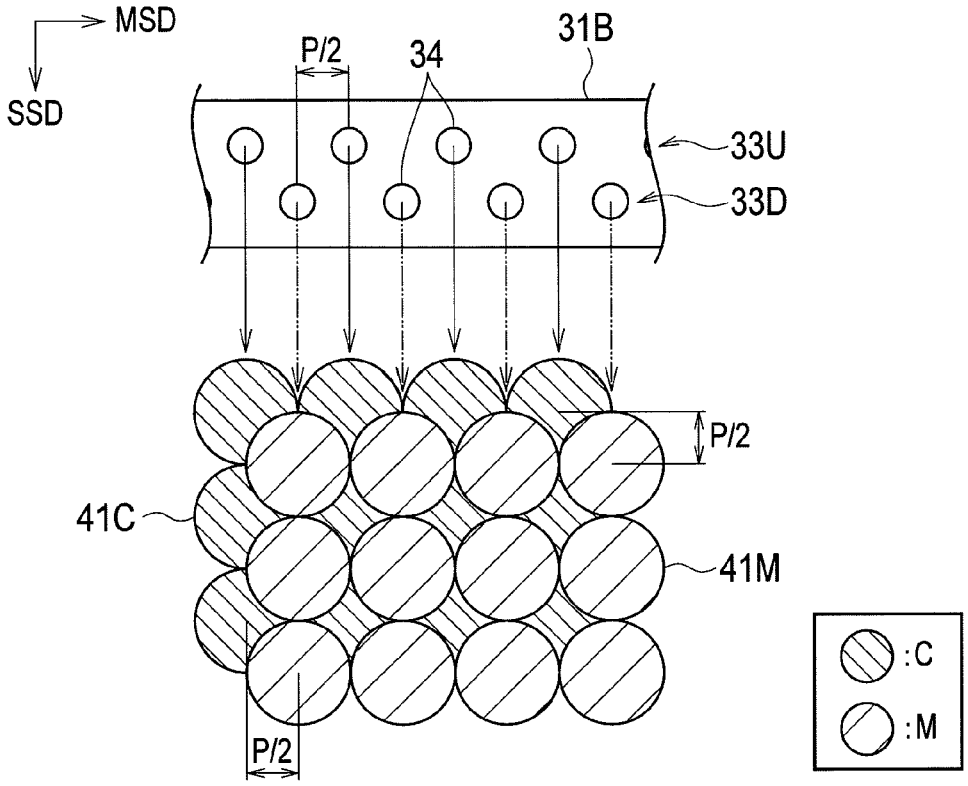
FIG. 8 is a view showing an example of a dot image in a solid image printed by the inkjet printer in the embodiment.

Due to this, for example, when a solid image is printed by using the cyan and magenta inks, dots are formed as shown in FIG. 8. In FIG. 8, magenta dots 41M are formed at positions offset from cyan dots 41C for the same pixels, by a half pitch (P/2) in each of the main scanning direction and the sub-scanning direction.

The offset in the main scanning direction is due to such an arrangement that the positions of the nozzles 34 are offset from one another by a half pitch between the nozzle array 33U of each head module 31B which ejects the cyan ink and the nozzle array 33D of the head module 31B which ejects the magenta ink. The offset in the sub-scanning direction is due to ejection timing control of the cyan and magenta inks.

Figure 9:
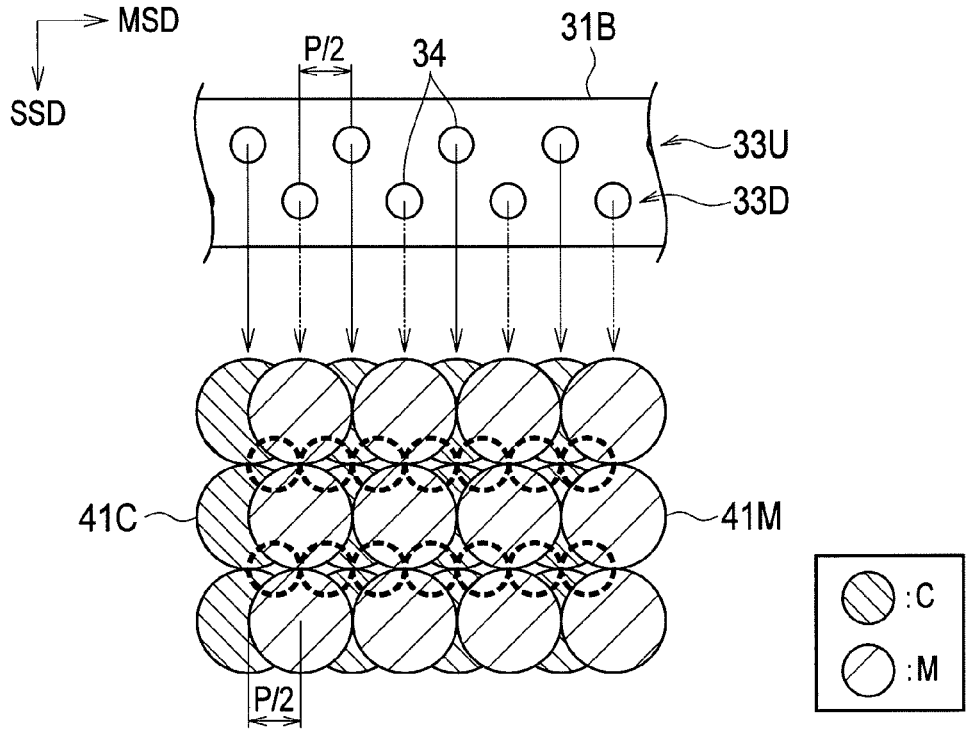
FIG. 9 is a view showing a comparative example of the dot image in the solid image.

When, unlike the embodiment, a solid image is printed in such a way that the cyan ink and the magenta ink which correspond to the same pixel land at the same position in the sub-scanning direction, the dots 41C, 41M are formed as shown in FIG. 9. In this case, as shown in portions surrounded by broken lines in FIG. 9, blank portions which are not filled with dots are formed in a solid region.

Meanwhile, in the inkjet printer 1 of the embodiment, as shown in FIG. 8, offsetting the positions of the dots 41C, 41M in the sub-scanning direction can reduce the blank portions which are not filled with dots.

Figure 10:
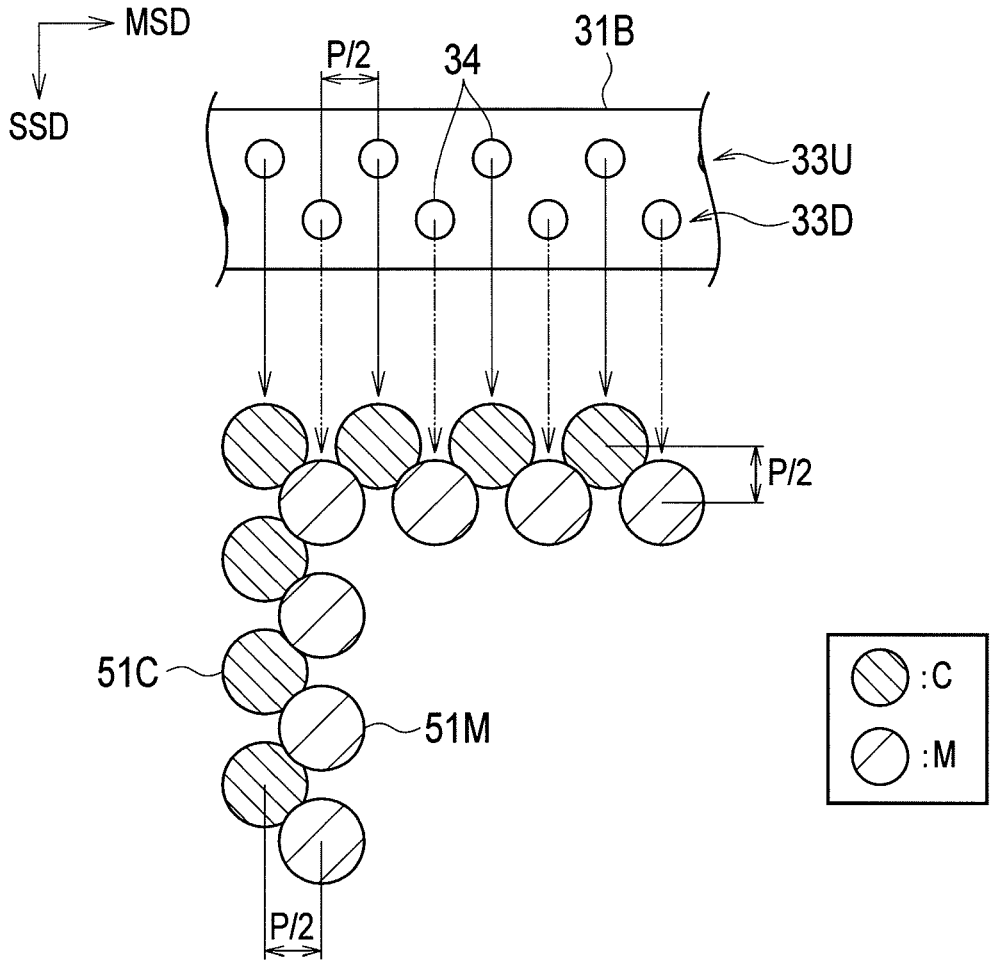
FIG. 10 is a view showing an example of a dot image of a fine line printed by the inkjet printer in the embodiment.

Moreover, for example, when a fine line extending along the main scanning direction and a fine line extending along the sub-scanning direction are printed by using the cyan and magenta inks, dots are formed as shown in FIG. 10. In FIG. 10, magenta dots 51M are formed at positions offset from cyan dots 51C for the same pixels by a half pitch in each of the main scanning direction and the sub-scanning direction.

Due to this, the thickness of the fine line extending along the main scanning direction and the thickness of the fine line extending along the sub-scanning direction are equal to each other. Moreover, since the dots 51C, 51*m* are formed with the numbers of droplets (ink ejection amounts) being reduced by the fine line processing, the thicknesses of the fine lines are reduced.

Figure 11:
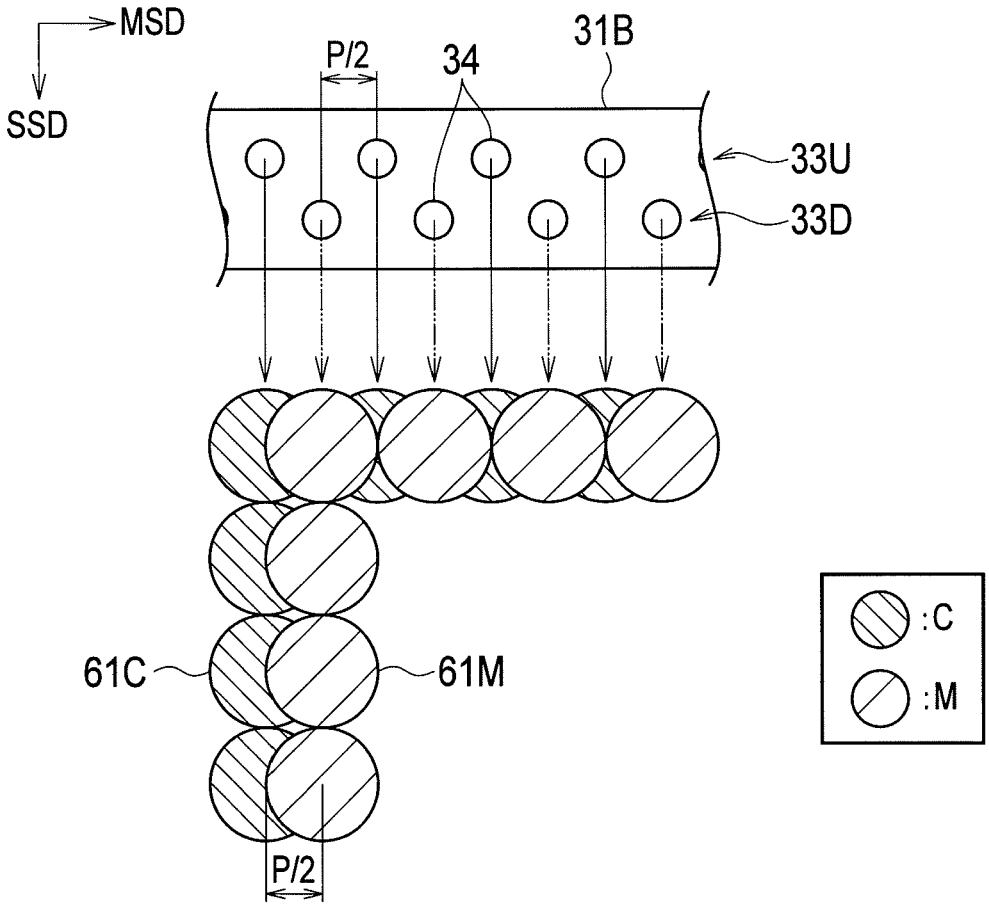
FIG. 11 is a view showing a comparative example of the dot image of the fine line.

FIG. 11 shows a dot image in a case where, unlike the embodiment, a fine line extending along the main scanning direction and a fine line extending along the sub-scanning direction are printed in such a way that the cyan ink and the magenta ink which correspond to the same pixel land at the same position in the sub-scanning direction without the fine line processing being performed.

In this case, the positions of cyan dots 61C and the positions of magenta dots 61M are the same in the sub-scanning direction which is a width direction of the fine line extending along the main scanning direction. Meanwhile, the positions of the dots 61C, 61M are offset from one another by a half pitch in the main scanning direction which is a width direction of the fine line extending along the sub-scanning direction, according to the offset of the positions of the nozzles 34 in the nozzle arrays 33U, 33D. Accordingly, the fine line extending along the sub-scanning direction is thicker (width is wider) than the fine line extending along the main scanning direction.

Figure 12:
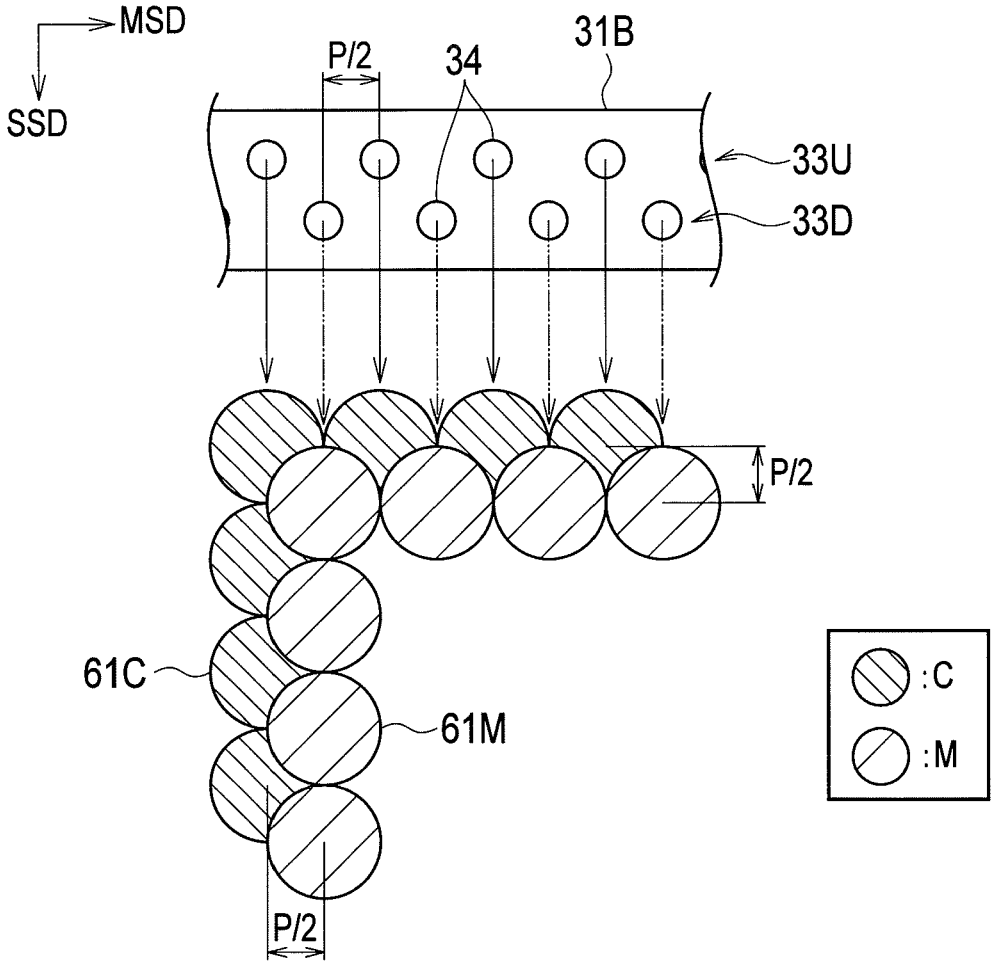
FIG. 12 is a view showing another comparative example of the dot image of the fine line.

Moreover, FIG. 12 shows a dot image in a case where a fine line extending along the main scanning direction and a fine line extending along the sub-scanning direction are printed in such a way that the cyan ink and the magenta ink which correspond to the same pixel land at positions offset from each other by a half pitch in the sub-scanning direction without the fine line processing being performed.

In this case, the thickness of the fine line extending along the main scanning direction and the thickness of the fine line extending along the sub-scanning direction can be made to be equal to each other. However, the fine line extending along the main scanning direction and the fine line extending along the sub-scanning direction are lines with a width thicker than an original width of one pixel.

Meanwhile, in the inkjet printer 1 of the embodiment, as shown in FIG. 10, the thickness of the fine line extending along the main scanning direction and the thickness of the fine line extending along the sub-scanning direction are equal to each other and, in addition, the thicknesses of these fine lines are reduced.

As described above, in the inkjet printer 1, the controller 4 controls the ejection timings of the inks from the nozzle arrays 33 in such a way that the dots of the color inks for each pixel can be offset from one another by an equal offset amount in the main scanning direction and the sub-scanning direction. This can reduce blank portions in a solid region. Moreover, a fine line extending along the main scanning direction and a fine line extending along the sub-scanning direction can be printed in the same thickness, the fine lines formed by using the color inks from the multiple nozzle arrays 33 some of which include the nozzles 34 at the positions offset in the main scanning direction. As a result, the inkjet printer 1 can suppress deterioration in printing quality.

Moreover, in the inkjet printer 1, the controller 4 performs the aforementioned fine line processing on the droplet data and executes printing. This can reduce the thicknesses of the fine line along the main scanning direction and along the sub-scanning direction formed by using the color inks from the multiple nozzle arrays 33 some of which include the nozzles 34 at the positions offset in the main scanning direction.

Note that in the fine line processing, the controller 4 can adjust the reduction amounts of the numbers of droplets depending on a type of sheet used for printing. Specifically, the numbers of the droplets can be reduced by a greater amount in types of sheets in which the inks are likely to bleed. The numbers of droplets can be thereby appropriately adjusted depending on the type of sheet.

In the embodiment described above, the configuration is such that the nozzle arrays 33U, 33D are offset from one another by a half pitch in the main scanning direction. However, the offset amount between the nozzle arrays is not limited to this. Moreover, in the embodiment described above, although the configuration is such that each two of the nozzle arrays 33U, 33D are offset from each other in the main scanning direction, the configuration of the nozzle arrays is not limited to this. The present invention can be applied to any configuration as long as at least one of multiple nozzle arrays corresponding respectively to different color inks is arranged such that the positions of nozzles thereof are offset in the main scanning direction with respect to at least one of the other nozzle arrays.

Moreover, in the embodiment described above, although a line with a width of one pixel is defined as fine line, a line with a width of a predetermined number of pixels equal to or more than two pixels may be defined as fine line.

Furthermore, the fine line processing may be omitted.

Moreover, in the embodiment described above, description is given of the line inkjet printer configured to perform printing while moving the sheet. However, the present invention not limited to this and can be applied to any inkjet printer which performs printing while moving an inkjet head and a sheet relative to each other. For example, the present invention can be applied to a serial inkjet printer which performs printing while moving an inkjet head.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a printing unit including a plurality of nozzle arrays each having a plurality of nozzles arranged at an interval in a nozzle arrangement direction and configured to eject ink, the plurality of nozzle arrays being configured to eject the ink of different colors from each other from the plurality of nozzles;

a driver configured to move the printing unit and a print medium relative to each other in a relative movement direction orthogonal to the nozzle arrangement direction; and a controller configured to control the printing unit and the driver such that the printing unit ejects the ink from the plurality of nozzles to the print medium on a basis of image data while the driver moves the printing unit and the print medium relative to each other, wherein positions of the plurality of nozzles of at least one first nozzle array of the plurality of nozzle arrays and positions of the plurality of nozzles of at least one second nozzle array of the plurality of nozzle arrays other than the at least one first nozzle array are offset from one another in the nozzle arrangement direction, and wherein the controller is configured to control ejection timings of the ink from the plurality of nozzle arrays such that dots of the ink of the colors for each same pixel are offset from each other by an equal offset amount in the relative movement direction and the nozzle arrangement direction.

2. The inkjet printer according to claim 1, wherein the controller is configured to reduce ink ejection amounts of the colors for each pixel in first and second lines contained in the image data from original ink ejection amounts based on the image data, the first and second lines being to be formed by using the ink of the colors from the at least one first nozzle array and the at least one second nozzle array, the first line extending in the nozzle arrangement direction and having a width equal to or smaller than a predetermined number of pixels, the second line extending in the relative movement direction and having a width equal to or smaller than the predetermined number of pixels.

* * * * *